US005360113A

United States Patent [19]

Harris

[11] Patent Number: 5,360,113

[45] Date of Patent: Nov. 1, 1994

[54] ENCLOSED SLEEVE-TYPE CARRIER

[75] Inventor: Randall L. Harris, Powder Springs, Ga.

[73] Assignee: Riverwood International Corporation, Atlanta, Ga.

[21] Appl. No.: 147,216

[22] Filed: Nov. 3, 1993

[51] Int. Cl.[5] ..... B65D 65/12

[52] U.S. Cl. ..... 206/427

[58] Field of Search ..... 206/427, 429, 434, 435, 206/139, 140, 147, 162; 229/40

[56] References Cited

U.S. PATENT DOCUMENTS

| | | | |
|---|---|---|---|
| 2,751,075 | 6/1956 | Arneson | 206/427 |
| 4,131,230 | 12/1978 | Koehlinger et al. | 229/40 |
| 4,216,861 | 8/1980 | Oliff | 206/427 |
| 5,020,668 | 6/1991 | Schuster | 206/427 |
| 5,197,656 | 3/1993 | Hoell et al. | 229/40 |
| 5,221,042 | 6/1993 | Oliff | 206/427 X |
| 5,246,112 | 9/1993 | Stout et al. | 206/427 |
| 5,249,681 | 10/1993 | Miller | 206/427 |
| 5,292,059 | 3/1994 | Oliff | 229/40 X |

*Primary Examiner*—Bryon P. Gehman

[57] ABSTRACT

A carrier having an end panel construction that snaps into place during formation of the carrier and has the ability to follow the contour of adjacent curved or beveled packaged articles. Gusset panels or tabs foldably connected to the lower end panel flap and adjacent glue flaps cause the flaps to snap into place. A bevel panel between the glue flaps and the side panels or dual angled fold lines connecting the glue flaps to the side panels enable the carrier to tightly follow the contour of curved corner articles in the carrier.

3 Claims, 5 Drawing Sheets

ENCLOSED SLEEVE-TYPE CARRIER

FIELD OF THE INVENTION

This invention relates to article carriers which are adapted to be loaded through the open ends of an interim sleeve configuration. More particularly, it relates to an end panel arrangement which facilitates closing the ends of the carrier and allows the end corner portions of a fully enclosed carrier to follow the contour of the packaged articles.

BACKGROUND OF THE INVENTION

Sleeve-type carriers are typically formed from a blank which is delivered to a packaging machine in the form of a collapsed sleeve. The sleeve is erected or opened in the machine and articles are loaded through one or both ends of the sleeve, after which the ends of the carrier are closed. Formation of the end panels of the carrier normally requires the top and bottom end panel flaps, and the dust or glue flaps to which the end panel flaps are glued, to be folded into place by separate folding steps.

When forming a fully enclosed carrier, such as one used to package long neck bottles, the upper portions of the end panels are often tapered so as to better follow the contour of the end bottles. To accomplish this the side panels are wider at the bottom than at the top, with the lower portion of the side panels being of constant width and the upper portion being tapered. The glue flaps hinged to the end edges of the side panels are basically comprised of a single flap containing a cutout extending in from the outer edge of the flap to a point near the juncture of the tapered upper end edge of the side panel and the straight lower end edge portion. This creates a narrow connecting strip between the upper and lower segments of the glue flap. The cutout plus a score line in the connecting strip allows the two segments of the glue flaps to shift as necessary when folded into place in order to accommodate the segments to the tapered shape of the end panels. Because folding of the upper segment of the glue flaps is resisted by the angled relationship of its fold line to the fold line of the lower segment, a "kicker" wheel is normally required to overcome this resistance. Use of kicker wheels, however, creates other problems. The impact of the kicker wheels makes it more difficult to maintain the carrier in square condition, and the time required for the kicker wheels to fold the glue flaps in place makes it necessary to reduce the machine speed.

It would be desirable to be able to form a tapered carrier without employing segmented glue flaps. By utilizing a unitary glue flap the need for a kicker wheel would be eliminated. It would also be desirable to have a carrier which is capable of more closely following the contours of bottles or other tapered articles in order to more tightly hold the articles within the package. Normally, the end panels of a sleeve-type carrier are not capable of closely following the contour of necked bottles in both the end panel area and in the corner areas between the end and side panels. It is therefore an object of the invention to provide a sleeve-type carrier that can provide a tighter package and not slow the speed of the packaging machine.

BRIEF SUMMARY OF THE INVENTION

A sleeve-type carrier is provided with an end panel comprised of transversely extending glue flaps and overlying upper and lower end panel flaps. The lower end panel flap is foldably connected to the bottom panel and to gusset tabs. The tabs are also foldably connected to the glue flaps. This arrangement permits the carrier sleeve to be loaded with articles when the lower end panel flap is in its horizontally open position, and causes the glue flaps to automatically move into closed position when the lower end panel flap is moved first to an open vertical position, then to its closed position. The tabs are folded about their fold lines so that they are in face-to-face relationship with the interior face of the end panel flap and with the exterior face of the associated glue flap. In addition, means are provided for causing the end panels to tightly hold adjacent curved or tapered articles in place. The lower end panel flap fold line preferably has a length less than the width of the bottom panel.

In one embodiment the means for causing the end panels to tightly hold adjacent curved or tapered articles in place comprises bevel panels foldably connected to the adjacent glue flap and side panel and having a greater width. at the top than at the bottom. In another embodiment the means comprises a first glue flap fold line connecting a lower portion of the glue flaps to an associated side panel and a second glue flap fold line connecting an upper portion of the glue flaps to the associated side panel, each second glue flap fold line forming an angle with the associated first glue flap fold line and being angled toward the opposite end panel.

The carrier design permits unitary glue flaps to be employed even though the package is tapered to conform to the outline of the articles inside. In addition, the automatic closure of the flaps due to the action of the gusset panels does away with the need to employ kicker wheels to close the glue flaps.

The above and other aspects and benefits of the invention will readily be apparent from the more detailed description of the preferred embodiments of the invention which follows.

DETAILED DESCRIPTION OF THE PREFERRED EMBODIMENTS

Figure 1:
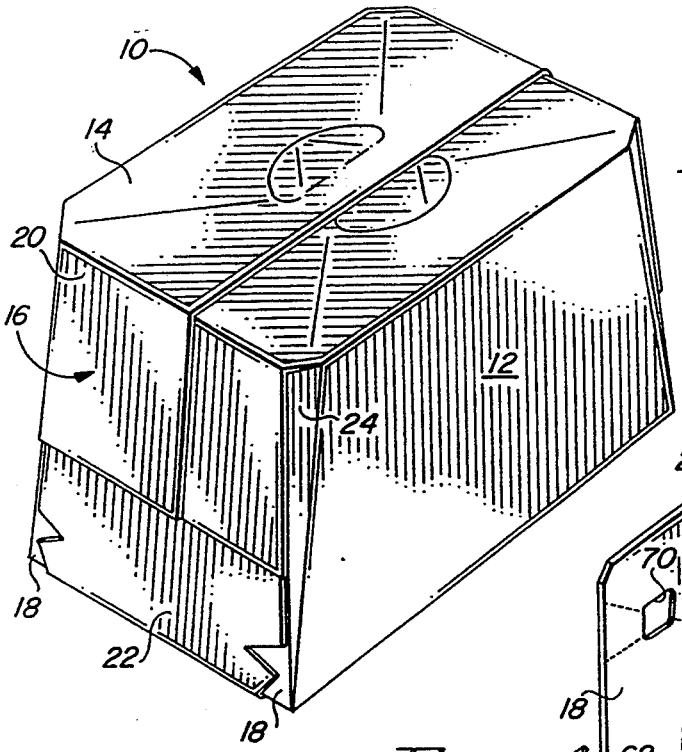
FIG. 1 is a pictorial view of the carrier of the invention.

Referring to FIG. 1, a carrier 10 embodying the invention includes side panels 12 connected to top panel 14 and to a bottom panel, not visible in this view. The carrier includes end panels 16 which are comprised of glue flaps 18 extending transversely from the side panels 12, and upper and lower end panel flaps 20 and 22, respectively, overlying the glue flaps. Bevel panels 24 connect the glue flaps 18 to the side panels 12. The end panels and bevel panels snugly engage the cylindrical contour of adjacent bottles while also tapering in from the barrel of the bottle to the bottle cap to provide a very tight package.

Figure 2:
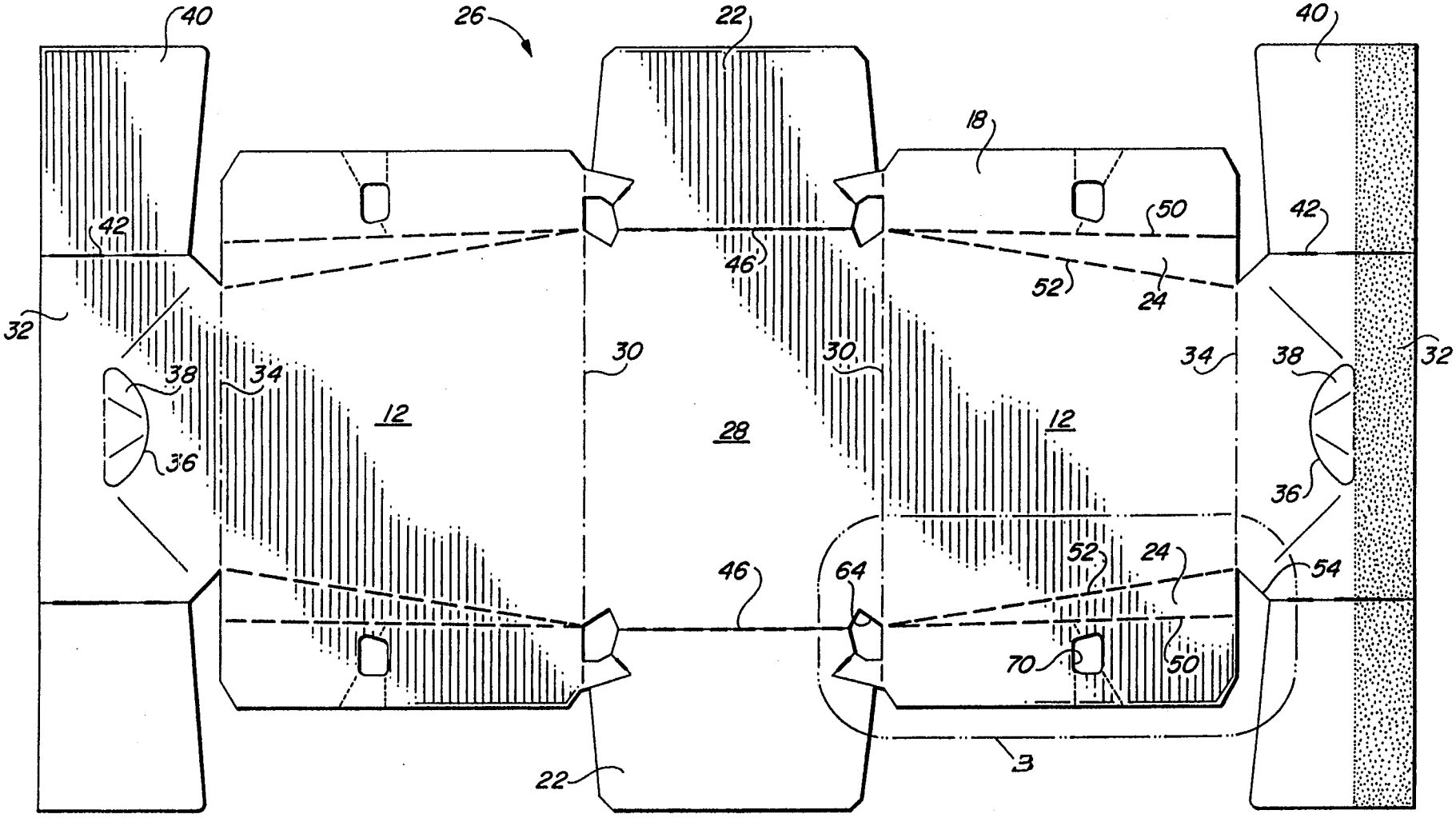
FIG. 2 is a plan view of a blank used to form the carrier.

The carrier is formed from the blank 26 shown in FIG. 2, wherein like reference numerals to those used in FIG. 1 refer to similar elements. The blank is comprised of flexible sheet material of suitable strength, such as paperboard of conventional carrier thickness, divided into various sections. A bottom panel section 28 is connected to the side panel sections 12 by fold lines 30, and a top panel section 32 is connected to each of the side panel sections by fold lines 34. Each top panel section includes a handle opening 36 covered by a hinged flap 38. Upper end panel flaps 40, which are adapted to overlap to form the upper end panel flaps 20 of the carrier, are connected to the side edges of the top panel sections 32 along fold lines 42, and the lower end panel flaps 22 are connected to the edges of the bottom panel section 28 along fold lines 46. In addition, the glue flaps 18 are connected to the bevel panel sections 24 by fold lines 50, and the bevel panel sections in turn are connected to the side panel sections 12 by diagonal fold lines 52. It can be seen that the top edge of the side panel sections, represented by fold line 34, is shorter than the bottom edge, represented by the fold line 30, so that the side edges of the side panels angle out toward the bottom of the carrier. Also, the ends of the fold lines 42 of the upper end panel flaps 40 connect with the ends of the fold lines 34 by diagonal edges 54. Although the fold lines 50 appear to be at right angles to the top and bottom edges of the side panel sections, they preferably form a slight angle with these edges in order to more readily fold in around an adjacent bottle in the package.

Figure 3:
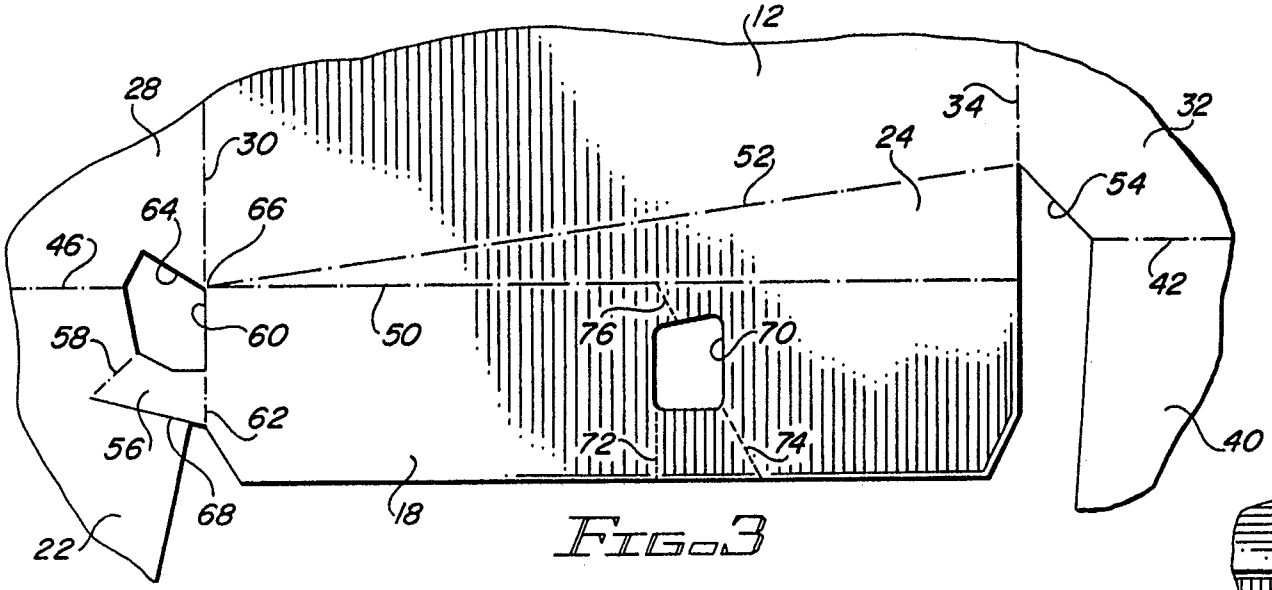
FIG. 3 is an enlarged view of the portion enclosed by the oval 3 of FIG. 2.

Referring to FIG. 3 as well as FIG. 2, the lower end panel flaps 22 are connected to the adjacent glue flaps 18 by a gusset panel or tab 56. The tabs 56 are connected to the lower end panel flaps 22 along fold lines 58 located intermediate the fold line 46 and the end of the lower end panel flap 20, and to the glue flaps 18 at the end portion of the glue flap edge 60 along fold line 62. The tab fold lines 62 are substantially aligned with the fold lines 30, while the tab fold lines 58 are angled out so that the fold lines 58, if extended, would form an acute angle with extensions of the fold lines 62. The configurations of the tabs 56, the lower end panel flaps 22 and the bottom panel section 28 are such that cutouts 64 are defined by spaced edge portions of these elements and the edge 60 of the glue flaps 18, an arrangement made possible by the fact that the fold line 46 is shorter than the width of the bottom panel. The cutouts extend through the intersection 66 of the fold lines 30, 50 and 52. Because the tab fold lines 58 are spaced from the side edges of the lower end panel flap 22, the lower edge of the tab. is formed by slits 68 in the lower end panel flap. If the side edge of the lower end panel flap extended down directly from the lower end of the tab fold line 58, there of course would be no need for the slits.

The glue flaps 18 may also include a shoulder cutout or opening 70 located so as to be opposite the upper edge or shoulder of the barrel of an adjacent bottle in a package. Spaced fold lines 72 and 74 connect the cutout to the outer edge of the glue flap 18, while fold line 76 connects the opposite end of the cutout to the fold line 50. The fold line 72 preferably is at right angles to the outer edge of the glue flap, while fold line 74 is angled in the upper portion of the flap. The fold line 76 preferably is at the same angle as the fold line 74 and is an extension of that fold line.

Figure 4:
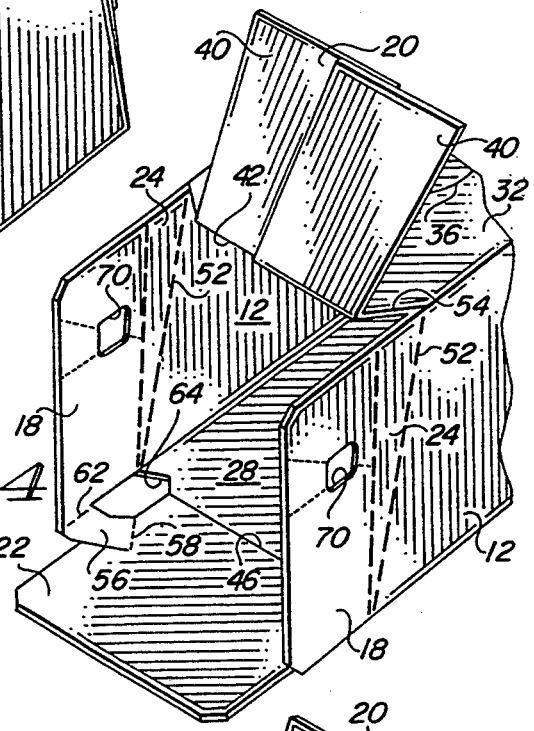
FIG. 4 is a pictorial view of an open end of a carrier sleeve in condition to be loaded with articles.

To form a carrier from the blank, one of the side panel sections 12 is folded in about its fold line 30 and the remote top panel section 32 is folded in about fold line 34 so that adhesive on the top panel section adjacent the folded side panel section, illustrated in FIG. 2 by the stippling at the right of the blank, adheres the overlapped top panel sections together. This results in a collapsed sleeve, which is subsequently introduced to a packaging machine where the sleeve is squared up and erected in a manner well known in the art. The resulting erected sleeve is illustrated in FIG. 4, wherein the lower end panel flap 22 is substantially an outward extension of the bottom panel 28, and the glue flaps 18 and bevel panel 24 are extensions of the side panels 12. The upper end panel flap 20, formed from the overlapping adhered flaps 40, typically is folded up at this point so as not to interfere with the introduction of the articles to be packaged.

Figure 5:
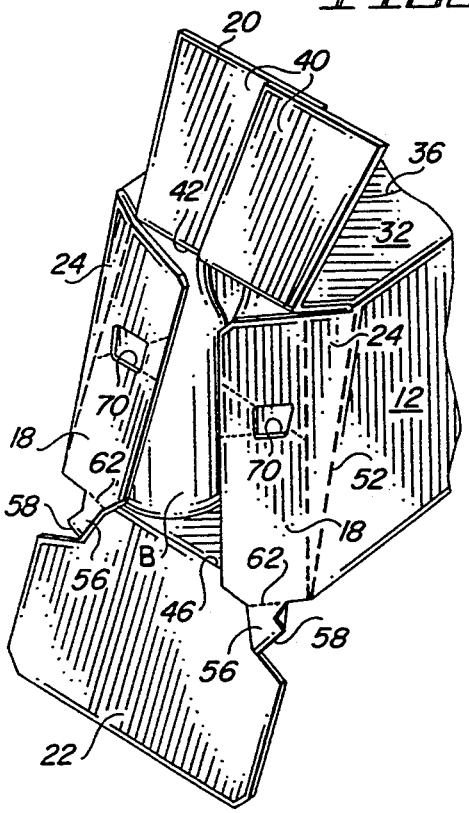
FIG. 5 is a pictorial view of the open end of the carrier sleeve of FIG. 4, with the lower end panel flap shown in vertically lowered position and the glue flaps in partially closed position.
Figure 6:
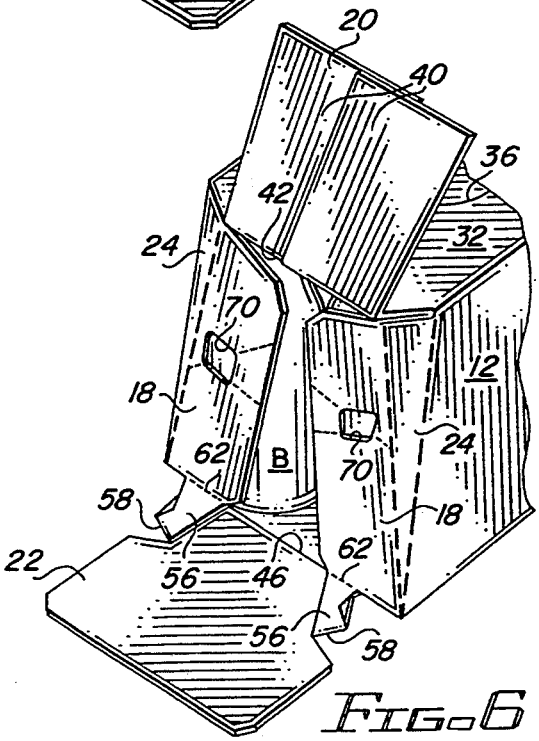
FIG. 6 is a pictorial view of the open end of the carrier sleeve of FIG. 4, with the end panel flap shown in interim horizontal position in the course of being moved into final closed position.

After the articles, such as the long necked bottles B, have been loaded, the end panels are closed by first pivoting the lower end panel flap 22 down so that it forms substantially a right angle with the bottom panel 28. As shown in FIG. 5, downward movement of the lower end panel flap 22 causes the gusset tabs 56 to fold up about their fold lines 58, which in turn causes the glue flaps 18 and the bevel panel 24 to pivot inwardly as a unit about the bevel panel fold lines 52 to a position somewhat short of their fully closed position. This movement of the glue flaps brings the fold lines 62 of the gusset tabs 56 into substantially horizontal position, so that when the lower end panel flap 22 is subsequently pivoted back up into its original open position, as shown in FIG. 6, the tabs 56 fold up about the fold lines 62. This causes the glue flaps 18 and connected bevel panels 24 to move to their final closed position in which the glue flaps are substantially at right angles to the side panels and the top edges of the bevel panels are directly beneath the diagonal edges 54 of the top panel. It will be understood that the biases created at the fold lines 58 and 62 by this folding action result in the gusset tabs and glue flaps being essentially locked into place.

The final step in closing the ends of the carrier in order to produce the package of FIG. 1 is to fold the lower end panel flaps 22 up about their fold lines 46 and the upper end panel flaps 20 down about their fold lines 42 to adhere them to the glue flaps 18 by adhesive applied to the end portions of the upper and lower end panel flaps. The adhesive will preferably be applied to the gusset tabs 56 as well, to adhere both the tabs and the lower end panel flaps directly to the glue flaps. As can be seen from FIG. 6, the tabs 56 in the final carrier configuration will lie directly between the lower end panel flap 22 and the glue flaps 18 in face-to-face relationship with both.

Figure 7:
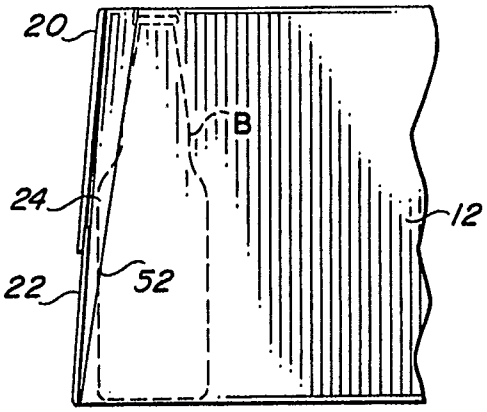
FIG. 7 is a partial side elevation of the carrier.

Referring now to FIG. 7 in addition to FIGS. 1–6, the angled fold lines 52 between the bevel panels 24 and the side panels 12 permit the bevel panels to flex around the curved contours of adjacent bottles and to contact the bottles at an angle designed to engage both the shoulder of the bottles and the tops of the bottles. The bottom portions of the glue flaps 18 extend at substantially right angles to the side panels so that the bottom edges of the glue flaps can be in contact with the bottom panel. Because the fold line 50 is at a slight angle to the bottom fold line 30, the glue flaps lie at a slight angle to the vertical in the carrier, which results in the adhered end panel flaps to also take on the same angle. The bottom portions of the end panels thus follow the slightly tapered shape of the barrel of the bottles.

Figure 8:
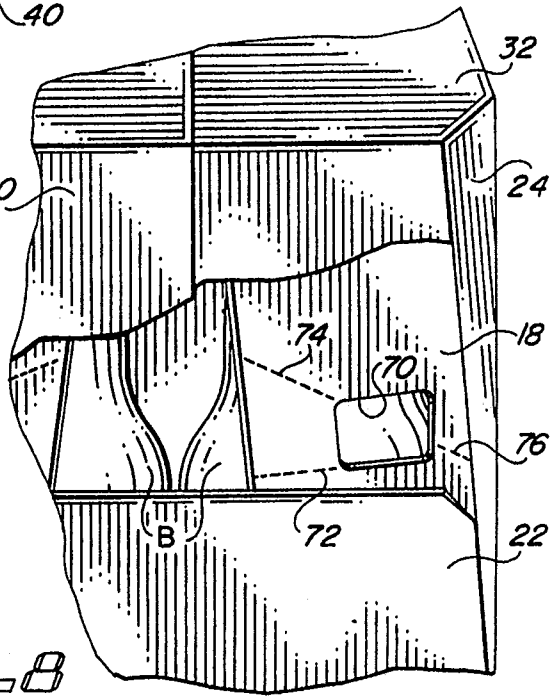
FIG. 8 is an enlarged partial perspective of the carrier, with portions of the upper end panel flaps removed in order to view the folded glue flaps.

In addition, as shown better in FIG. 8, the shoulder cutouts 70 and the related fold lines 72, 74 and 76 allow the glue flaps to fold or flex in this area. The end panels of the package are therefore able to taper in to the tops of the bottles, providing for a tight package. By providing cutouts, the length of the fold lines is reduced, thereby offering less resistance to the flexing of the glue flaps. In addition to providing this function, the cutouts allow the glue flaps to follow the contour of the shoulder of adjacent bottles, with the edges of the cutouts providing a "bite" to better grip and hold the bottles in place. It should be understood that the particular shape and location of the cutouts 70 are functions of the contour of the packaged bottles, and as such may be different than as illustrated in the drawing. Although preferred when the contour of the bottles is such that the cutouts promote a tighter fit of the glue flaps against the bottles, the carrier of the invention need not always be provided with them. For example, they are not essential when a tight closure can be obtained without them.

Figure 9:
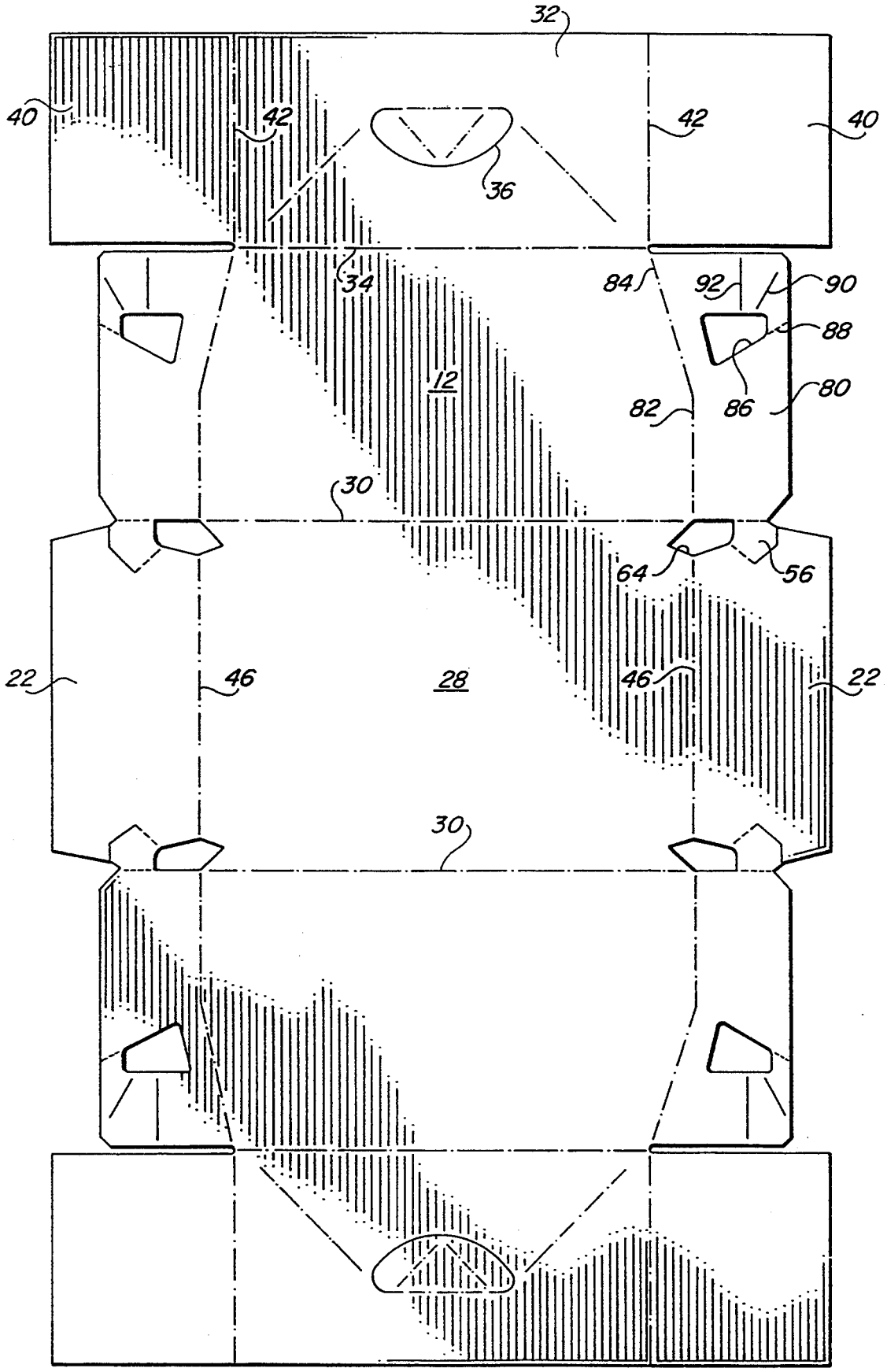
FIG. 9 is a plan view of a modified carrier blank.

Referring now to FIG. 9, a modified blank is illustrated which differs from the first embodiment primarily in the design of the glue flaps. As in the first embodiment, the bottom panel section 28 is connected to side panel sections 12 by fold lines 30, and to lower end panel flaps 22 by fold lines 46. The side panel sections 12 are connected to top panel sections 32 by fold lines 34, and the top panel sections include upper end panel flaps 40. In this embodiment, however, the glue flaps 80 are shaped differently from the glue flaps of the first embodiment and there are no bevel panels. Instead the glue flaps 80 are connected to the side panel sections by a first fold line 82, which is an extension of the fold line 46, and a second fold line 84, which extends from the end of the first fold line 82 to the end of the fold line 34. As in the first embodiment, the glue flaps 80 are connected to the lower end panel flaps 22 by gusset panels or tabs 56, and cutouts 64 are defined by spaced edge portions of the glue flap 80, the lower end panel flap 22 and the bottom panel section 28. The glue flaps 80 may also include a shoulder cutout or opening 86 located so as to be opposite the upper edge or shoulder of the barrel of an adjacent bottle in a package. Spaced fold lines 88, 90 and 92 connect the cutout 86 to the outer edge of the glue flap 80 to promote flexing or bowing, as described in more detail below. Note that the fold lines 90 and 92 are illustrated as slits which are spaced from the cutout 86 and the edges of the glue flap 80. Slits are preferred in many cases as they facilitate bowing of the glue flap to a greater degree than conventional fold lines. The fold line 88 is illustrated as a conventional fold line since it is too short to consist of a single elongated slit.

Figure 10:
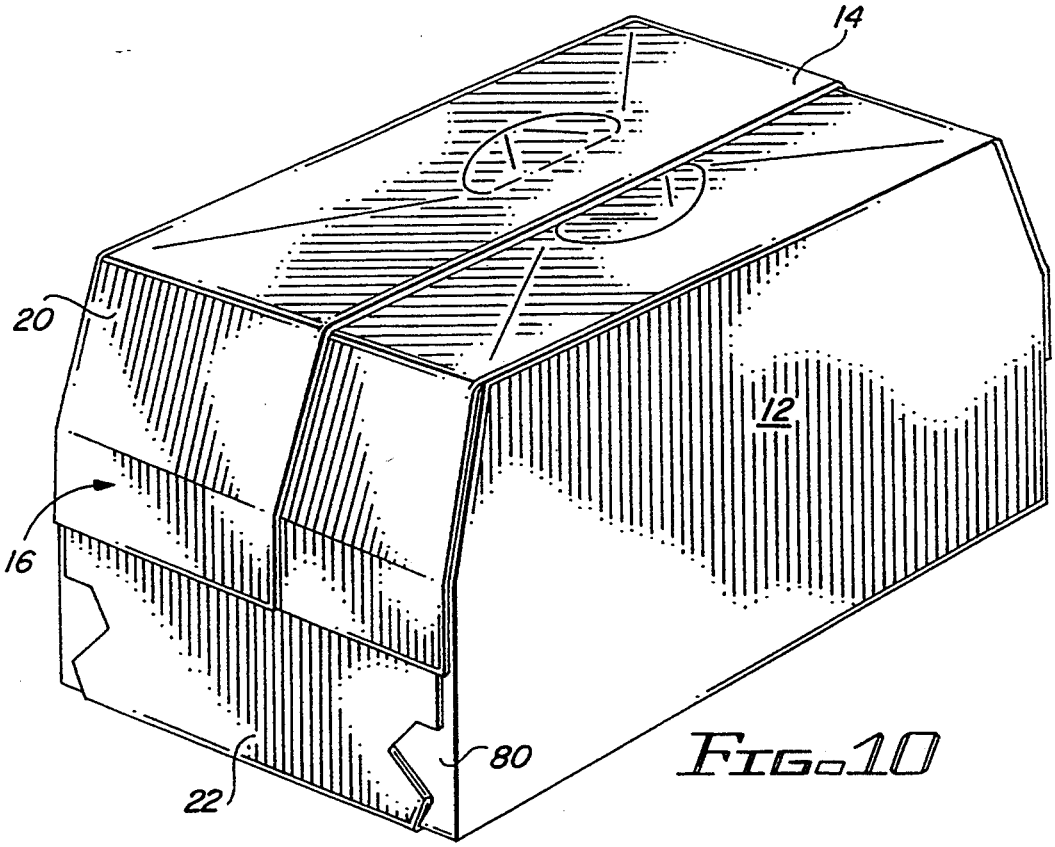
FIG. 10 is a pictorial view of a carrier formed from the modified blank of FIG. 9.
Figure 11:
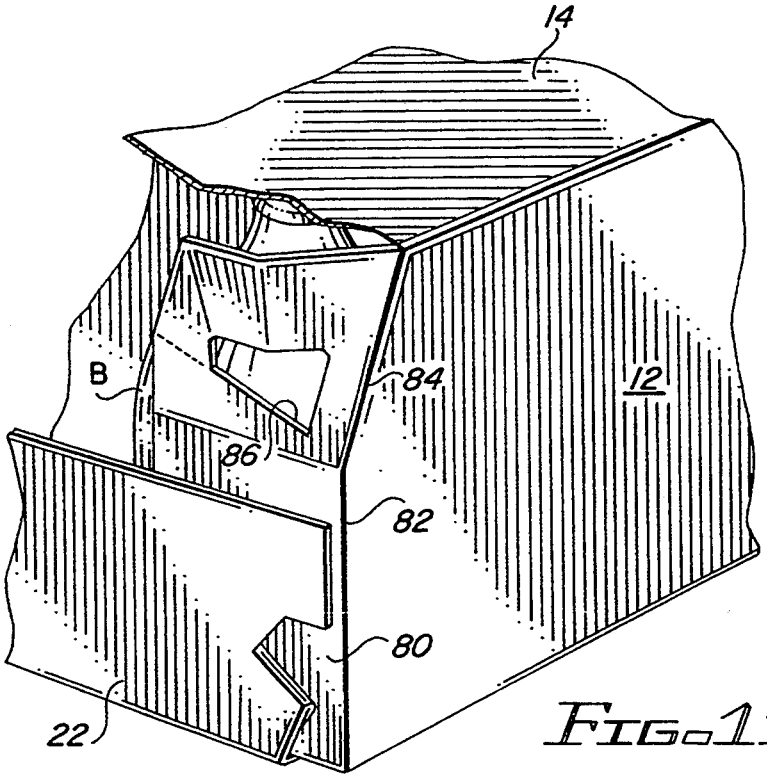
FIG. 11 is an enlarged partial perspective of the modified carrier, with the upper end panel flaps and portions of the top panel removed in order to view the folded glue flaps.

The modified carrier of FIG. 10 is fabricated from the blank in the manner described in connection with the first embodiment, following the steps illustrated in FIGS. 4, 5 and 6. However, in this case when the glue flaps 80 are folded in they fold about both the angled fold lines 82 and 84. The lower portion of a flap 80 tends to pivot about the fold line 82, while the upper portion tends to pivot about the fold line 84. The material of the flaps in the transition area between the upper and lower portions thus is subjected to stresses tending to move it in different directions, causing the flaps to slightly buckle or bow in this area. This biases the flaps inwardly toward the closed position shown in FIG. 11, and causes them to conform to the shape of the adjacent bottles. Although the fold lines 88, 90 and 92 and the cutout 86 enhance the ability of the flaps to flex and conform to the bottle contours, they are not essential to the functioning of the glue flaps since even without them the glue flaps will still have this ability as a result of the dual angled fold lines 82 and 84 about which the glue flaps pivot.

It will now be appreciated that the invention provides for automatic closing of the glue flaps as a result of the pivoting movement of the end panel flaps, which is made possible by the gusset tabs that connect the lower end panel flaps to the glue flaps. By employing unitary glue flaps while still being able to form a package having tapered end panels, there is no longer a need to use kicker wheels to close the glue flaps. The unique glue flap arrangement provides for engagement of the end panels with the tapered portions of adjacent bottles between the caps and the barrel, while the bevel panel of the first embodiment or the dual fold line of the glue flaps in the second embodiment provide a snug fit around the curved contour of the corner bottles.

It should now be apparent that the invention is not necessarily limited to all the specific details described in connection with the preferred embodiments but that changes to certain features of the preferred embodiments which do not alter the overall basic function and concept of the invention may be made without departing from the spirit and scope of the invention defined in the appended claims.

What is claimed is:

1. An enclosed sleeve-type carrier for packaging a plurality of articles having tapered upper portions, comprising:

top and bottom panels connected to side panels along fold lines to from a sleeve;

an end panel at each end of the sleeve;

each end panel being comprised of upper and lower end panel flaps connected by fold lines to the top and bottom panels, respectively, the end panel flaps being adhered to associated glue flaps extending transversely of the side panels;

the lower end panel flap of each end panel being connected on either side thereof to the lower portion of the associated glue flap by a gusset tab, each tab being connected to said lower portion by a first tab fold line and to the lower end panel flap by a second tab fold line, each tab being folded about its second tab fold line so as to be in face-to-face relationship with the interior face of the lower end panel flap, and about its first fold line so as to be in face-to-face relationship with the exterior face of the associated glue flap, the upper end panel flaps being joined only by glue to associated glue flaps;

the fold lines connecting the side panels to the top panel being shorter than the fold lines connecting the side panels to the bottom panel whereby the end panels are inwardly tapered;

bevel panels between the glue flaps and the side panels, each bevel panel being connected by a respective fold line to each of the adjacent glue flap and side panel, each bevel panel having a greater width at the top thereof than at the bottom, each bevel panel extending up from a lower corner of the sleeve, the fold lien connecting the bevel panel to the adjacent side panel meeting the fold line connecting the side panel to the top panel at one end of the fold line connecting the side panel to the top panels; and each glue flap having a free edge opposite the fold line connecting the glue flap to an adjacent bevel panel.

2. An enclosed sleeve-type carrier according to claim 1, wherein each glue flap includes an opening in an upper portion thereof.

3. An enclosed sleeve-type carrier according to claim 2, including at least one easily foldable line extending from the opening toward an end of the glue flap.

* * * * *